US008769725B2

(12) United States Patent
Doran

(10) Patent No.: US 8,769,725 B2
(45) Date of Patent: Jul. 8, 2014

(54) SPORTS MEMORABILLIA ARTICLE AND METHOD FOR MAKING THE SAME

(71) Applicant: Nicholas Doran, Lindenhurst, NY (US)

(72) Inventor: Nicholas Doran, Lindenhurst, NY (US)

( * ) Notice: Subject to any disclaimer, the term of this patent is extended or adjusted under 35 U.S.C. 154(b) by 18 days.

(21) Appl. No.: 13/629,875

(22) Filed: Sep. 28, 2012

(65) Prior Publication Data

US 2014/0090741 A1 Apr. 3, 2014

(51) Int. Cl.

| | |
|---|---|
| ***B65D 30/10*** | (2006.01) |
| ***B65D 30/06*** | (2006.01) |
| ***B65D 30/00*** | (2006.01) |
| *A44C 15/00* | (2006.01) |
| *A45C 3/00* | (2006.01) |

(52) U.S. Cl.

CPC ..... *B65D 29/00* (2013.01); *A45C 3/001* (2013.01); *A45C 2003/007* (2013.01)

USPC ..... 2/244; 2/338; 383/117; 63/37

(58) Field of Classification Search

CPC ..... A44C 11/00; A44C 27/00; A44C 27/002; A44C 5/025; A44C 5/0061; A44C 15/00; A44C 25/002; A44C 27/003; A44C 13/00; A44C 15/0005; A44C 15/005; A44C 5/2076; A44C 5/2095; A44C 5/246; A44C 5/105; A44C 5/2033; A44C 5/2042; A44C 5/24; A44C 9/02; A47F 7/02; A47F 7/19; B21D 31/04; A45C 13/10; A45C 3/001; A45C 13/08; A45C 13/083; A45C 13/30; A45C 2003/002; B21L 11/005; B21F 43/00; B21F 45/00; B32B 2305/18; B32B 2451/00; B32B 3/06; B32B 15/02; B32B 17/10247; B32B 2305/38; B32B 3/266; A45F 2005/008; A45F 5/00; A45F 2003/006; A45F 2005/006; A45F 3/02; A45F 3/04; A45F 4/02; A45F 5/02; D06Q 1/00; B44C 3/02; Y10S 248/915; Y10S 362/806; A41D 13/0015; A41D 1/22; A41D 27/08; A41D 27/085; A41D 31/0005; A63B 21/065; B23P 11/00; B23P 15/00; G09F 15/02; G09F 19/22; G09F 1/10; G09F 7/18; A41F 1/08; A41F 9/00; A43B 23/24; A43B 3/0078

See application file for complete search history.

(56) References Cited

U.S. PATENT DOCUMENTS

| | | | | |
|---|---|---|---|---|
| D39,581 | S | 9/1908 | Maag | |
| D84,214 | S | 5/1931 | Speidel | |
| 2,041,837 | A * | 5/1936 | Jecusco | 428/196 |
| 2,139,512 | A | 12/1938 | Nagorny | |
| 2,655,664 | A * | 10/1953 | Ramos | 2/338 |

(Continued)

*Primary Examiner* — Bobby Muromoto, Jr.

(74) *Attorney, Agent, or Firm* — Richard B. Klar; Law Office Richard B Klar

(57) ABSTRACT

An article is formed of one or more Lacrosse netting materials. In the case of two nettings, one is placed behind the other in a staggered arrangement. A Lacrosse shooting string is interwoven between the openings of the netting material to from an article as a sports memorabilia item to be worn. The shooting string can be pulled together and tied at its end in order to adjustably fit the wearer's neck, waist, and wrist, depending on whether the article is, for example, a necklace, belt or bracelet. A metal or plastic or other suitable material plate with a name, design, logo on it to promote and advertise a product or for any other purposes or to enhance decorative appearance of the article. This plate can be affixed at preferably the center of the front surface of the article by adhesive material or by any other known affixation technique.

18 Claims, 13 Drawing Sheets

(56) References Cited

U.S. PATENT DOCUMENTS

| | | | | |
|---|---|---|---|---|
| 3,741,202 | A * | 6/1973 | Morgan | 606/204.35 |
| 4,160,361 | A * | 7/1979 | East | 59/82 |
| D267,860 | S | 2/1983 | Kabaya | |
| 4,388,739 | A * | 6/1983 | Martinon et al. | 8/150 |
| 4,459,772 | A * | 7/1984 | Kanzelberger | 40/745 |
| 4,698,853 | A * | 10/1987 | Walton | 2/174 |
| 4,716,594 | A * | 1/1988 | Shannon | 2/4 |
| 4,819,458 | A * | 4/1989 | Kavesh et al. | 66/202 |
| 4,840,822 | A * | 6/1989 | Cheng | 428/4 |
| 5,092,682 | A * | 3/1992 | Fenick | 383/22 |
| 5,119,510 | A * | 6/1992 | Schilling | 2/4 |
| 5,150,970 | A * | 9/1992 | Albarelli | 383/76 |
| 5,222,259 | A * | 6/1993 | Bristor | 2/115 |
| 5,288,150 | A * | 2/1994 | Bearman | 383/38 |
| 5,297,416 | A * | 3/1994 | Alhamad et al. | 72/379.4 |
| 5,356,001 | A * | 10/1994 | Luna | 206/315.1 |
| 5,443,576 | A * | 8/1995 | Hauter | 473/424 |
| 5,683,769 | A * | 11/1997 | Cheng | 428/35.2 |
| 5,845,994 | A * | 12/1998 | Rice | 383/76 |
| 5,882,742 | A * | 3/1999 | Lin | 428/9 |
| 6,026,662 | A * | 2/2000 | Schlipper | 70/18 |
| 6,092,702 | A * | 7/2000 | Cassidy, IV | 224/153 |
| 6,112,936 | A * | 9/2000 | Arizmendi | 221/45 |
| 6,123,240 | A * | 9/2000 | Fowles et al. | 224/600 |
| 6,186,662 | B1 * | 2/2001 | Jackson | 383/16 |
| 6,224,259 | B1 * | 5/2001 | Guerra | 383/24 |
| 6,247,334 | B1 * | 6/2001 | Visser | 63/3 |
| 6,357,260 | B1 * | 3/2002 | Lutz | 63/1.11 |
| 6,626,570 | B2 * | 9/2003 | Fox et al. | 383/9 |
| 6,644,475 | B2 * | 11/2003 | Wilson, II et al. | 206/522 |
| D486,404 | S | 2/2004 | Shriqui | |
| 6,880,363 | B2 * | 4/2005 | Ma | 63/3.1 |
| 7,240,517 | B2 * | 7/2007 | Barak | 63/29.1 |
| 7,392,666 | B2 * | 7/2008 | Namiki | 63/4 |
| D577,305 | S | 9/2008 | Greenwood | |
| D600,141 | S | 9/2009 | Giannini | |
| D652,339 | S | 1/2012 | Zander | |
| D654,622 | S | 2/2012 | Hsu | |
| 2003/0007704 | A1 * | 1/2003 | Miller | 383/76 |
| 2003/0110633 | A1 * | 6/2003 | Disegna et al. | 29/896.4 |
| 2003/0208871 | A1 * | 11/2003 | Osborne | 15/209.1 |
| 2004/0168696 | A1 * | 9/2004 | Cox | 132/54 |
| 2004/0194502 | A1 * | 10/2004 | Ma | 63/3.1 |
| 2005/0076507 | A1 * | 4/2005 | Camargo et al. | 29/896.41 |
| 2005/0129337 | A1 * | 6/2005 | Sabounjian | 383/117 |
| 2005/0133558 | A1 * | 6/2005 | Toombs | 224/576 |
| 2005/0199002 | A1 * | 9/2005 | Barak | 63/13 |
| 2006/0011566 | A1 * | 1/2006 | Guy | 211/60.1 |
| 2006/0050998 | A1 * | 3/2006 | Cohen | 383/41 |
| 2006/0105865 | A1 * | 5/2006 | Bourdages | 473/476 |
| 2006/0226038 | A1 * | 10/2006 | Lampley | 206/315.9 |
| 2007/0017948 | A1 * | 1/2007 | Smithson | 224/663 |
| 2007/0028356 | A1 * | 2/2007 | Cabauy et al. | 2/161.6 |
| 2007/0051133 | A1 * | 3/2007 | Wolff | 63/35 |
| 2007/0245451 | A1 * | 10/2007 | Desjardins et al. | 2/159 |
| 2008/0016738 | A1 * | 1/2008 | Talbott et al. | 40/633 |
| 2008/0017196 | A1 * | 1/2008 | Kamneva | 128/201.23 |
| 2008/0063322 | A1 * | 3/2008 | Liang | 383/79 |
| 2008/0072621 | A1 * | 3/2008 | Townsend et al. | 63/1.18 |
| 2008/0101848 | A1 * | 5/2008 | Shaw et al. | 401/200 |
| 2008/0226204 | A1 * | 9/2008 | Sabounjian et al. | 383/74 |
| 2009/0205100 | A1 * | 8/2009 | Flower et al. | 2/67 |
| 2009/0241341 | A1 * | 10/2009 | Solanilla | 29/896.41 |
| 2009/0247331 | A1 * | 10/2009 | Schmidt | 473/513 |
| 2009/0249527 | A1 * | 10/2009 | Hunte | 2/84 |
| 2010/0000656 | A1 * | 1/2010 | Winningham et al. | 156/73.5 |
| 2010/0005677 | A1 * | 1/2010 | Janisse et al. | 33/562 |
| 2010/0044404 | A1 * | 2/2010 | Guy | 224/584 |
| 2010/0075785 | A1 * | 3/2010 | Winningham et al. | 473/513 |
| 2010/0236287 | A1 * | 9/2010 | Summerford | 63/1.12 |
| 2011/0085749 | A1 * | 4/2011 | Frei et al. | 383/117 |
| 2011/0179540 | A1 * | 7/2011 | Sutton | 2/9 |
| 2012/0029458 | A1 * | 2/2012 | Norman et al. | 604/385.14 |
| 2012/0160884 | A1 * | 6/2012 | Levine et al. | 224/148.5 |
| 2012/0192591 | A1 * | 8/2012 | Soto-Mendez et al. | 63/28 |
| 2012/0210501 | A1 * | 8/2012 | Lavin | 2/468 |
| 2012/0275729 | A1 * | 11/2012 | Liang et al. | 383/72 |
| 2013/0186785 | A1 * | 7/2013 | Alfred et al. | 206/278 |
| 2013/0205476 | A1 * | 8/2013 | Gentile et al. | 2/311 |
| 2013/0232660 | A1 * | 9/2013 | Rexroad et al. | 2/74 |
| 2013/0276996 | A1 * | 10/2013 | Huang et al. | 160/330 |

* cited by examiner

SPORTS MEMORABILLIA ARTICLE AND METHOD FOR MAKING THE SAME

BACKGROUND

1. Field

The present disclosure relates to a sport memorabilia article such as but not limited to a jewelry article and a method for making the same. In particular, the present disclosure relates to a sports memorabilia article for jewelry and other items made of Lacrosse material and the method for making the same. Sports memorabilia articles particularly for jewelry and garments have become very popular in today's culture. Lacrosse is developing as a popular sport in this nation and throughout the world. It would be desirable to have articles made from Lacrosse materials that would be a sports memorabilia article and which and can be worn by enthusiasts and fans of Lacrosse.

2. The Related Art

U.S. Pat. No. 2,655,664 (RAMOS HECTOR O) shows a belt made of band 1 having crest 2 and hollows 3 made through application of heat, strips 6 and 7 are helically wound tape 1 in opposite directions. U.S. Design Pat. No. D654622 (Hsu; Shih-Ling) shows a hair band with geometrical apertures. U.S. Design Pat. No. D039581 (M. V. Maag) discloses a woman wire collar with geometrical design.

SUMMARY

It would be desirable to make an article such as jewelry or garment item that is decorative and commemorative of Lacrosse which serves as a sports memorabilia item.

The present disclosure provides for this objective by providing in a first embodiment an article formed of two different colored Lacrosse netting materials, one placed behind but in staggered arrangement from the other and a Lacrosse shooting string that is interwoven between the openings of the two differently colored Lacrosse netting materials to from an article as a sports memorabilia item to be worn. The shooting string can be pulled together and tied at its end in order to adjustably fit the wearer's neck, waist, and wrist, depending on whether the article is for example a necklace, belt or bracelet. It is understood the invention is not limited to any one item and can be formed as and worn as a head band, wrist watch band, etc.

In a second embodiment the present disclosure can be formed from just one colored netting material where a shooting string is woven through the opening of the netting material and the ends of the shooting string are pulled together and tied to adjustably fit the wearer.

Further development for either of the above two embodiments would include adding a metal or plastic or other suitable material plate with a name, design, logo on it to promote and advertise a product or for any other purposes or to enhance decorative appearance of the article. This plate can be affixed at preferably the center of the front surface of the article by adhesive means or by any other known means.

DETAILED DESCRIPTION OF THE PREFERRED EMBODIMENTS

Figure 1:
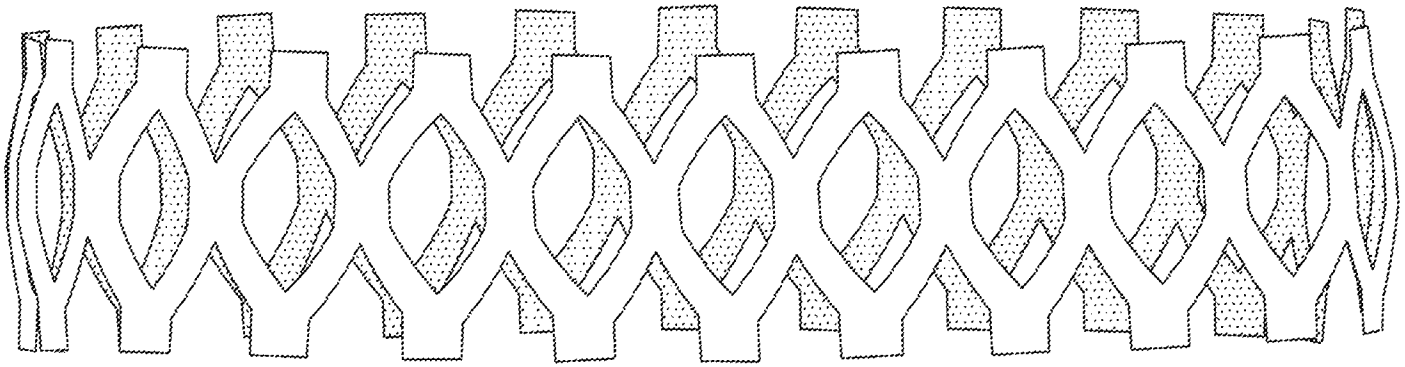
FIGS. 1-8 illustrate a first embodiment of the present disclosure in which an article formed of two different colored Lacrosse netting materials, one netting material is placed in a staggered arrangement behind the other netting material and a Lacrosse shooting string is interwoven between the openings of the two differently colored Lacrosse netting materials to from an article as a sports memorabilia item to be worn and illustrating the steps thereof.

Referring now to FIGS. 1-13 of the drawings, FIGS. 1-8 show a first embodiment of the present disclosure in which an article is formed of two different colored Lacrosse netting materials 5, 6 (see FIG. 1), one netting material placed behind the other netting material but in a staggered arrangement from the other so that they do not perfectly overlap and are offset from each other rather than being aligned centrally (see FIG. 1). A Lacrosse shooting string 7 (FIG. 2) is interwoven between the openings of the two differently colored Lacrosse netting materials (FIG. 3) to form an article as a sports memorabilia item 6 to be worn. The shooting string can be pulled together and tied at its end in order to adjustably fit the wearer's neck, waist, and wrist, depending on whether the article is for example a necklace, belt or bracelet. The method of making this article is described below for this embodiment of the present disclosure.

Figure 2:
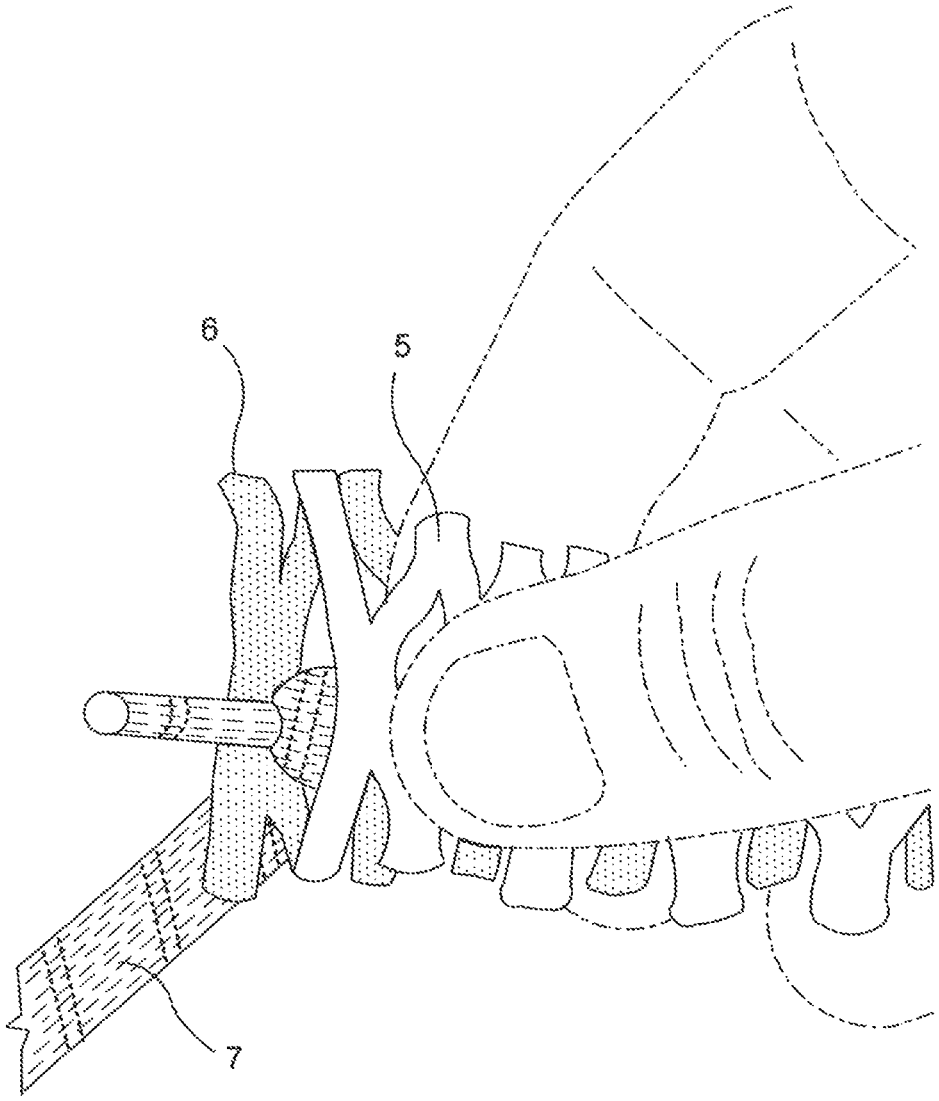
Figure 3:
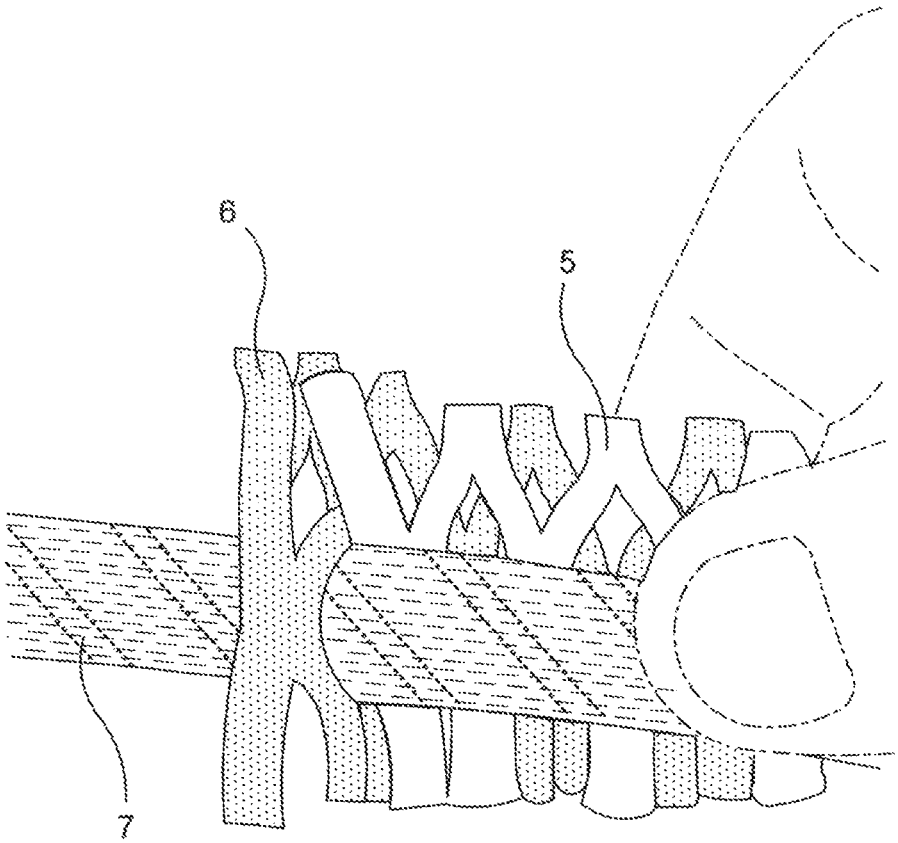
Figure 4:
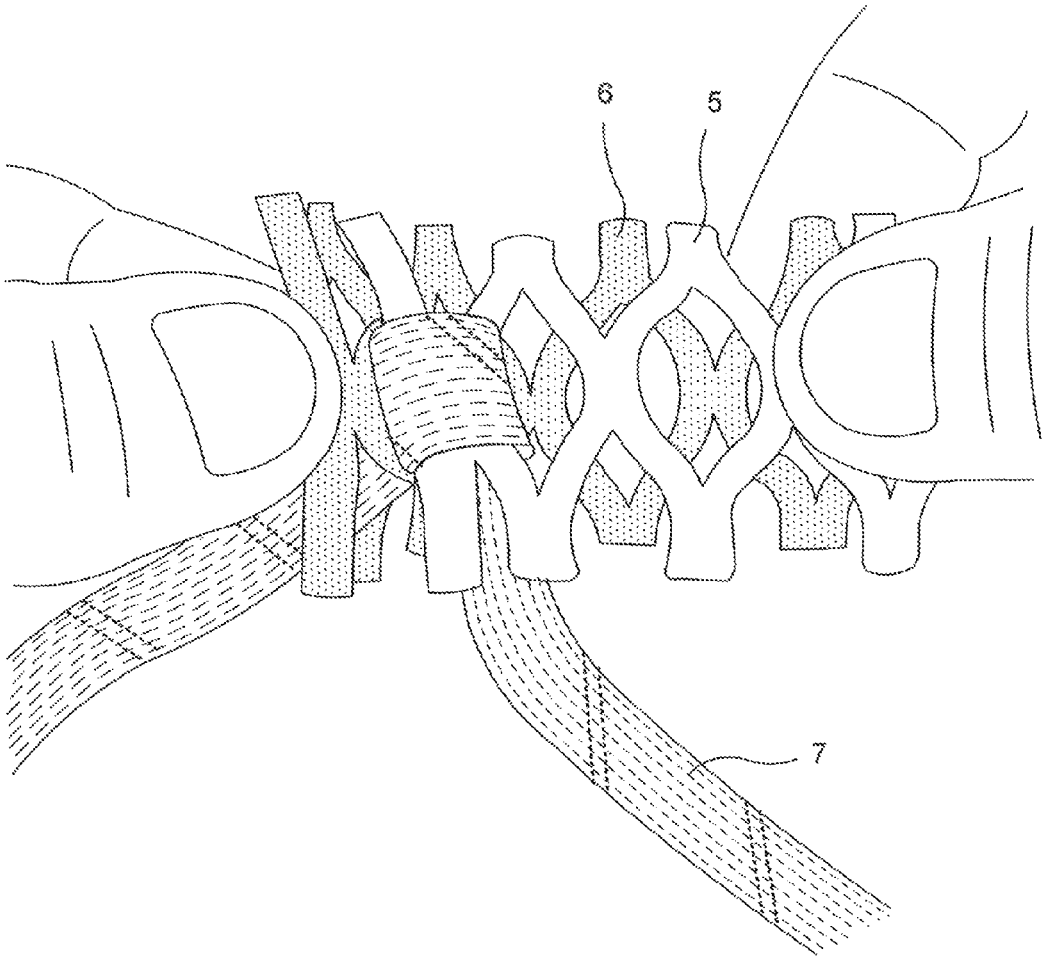
Figure 5:
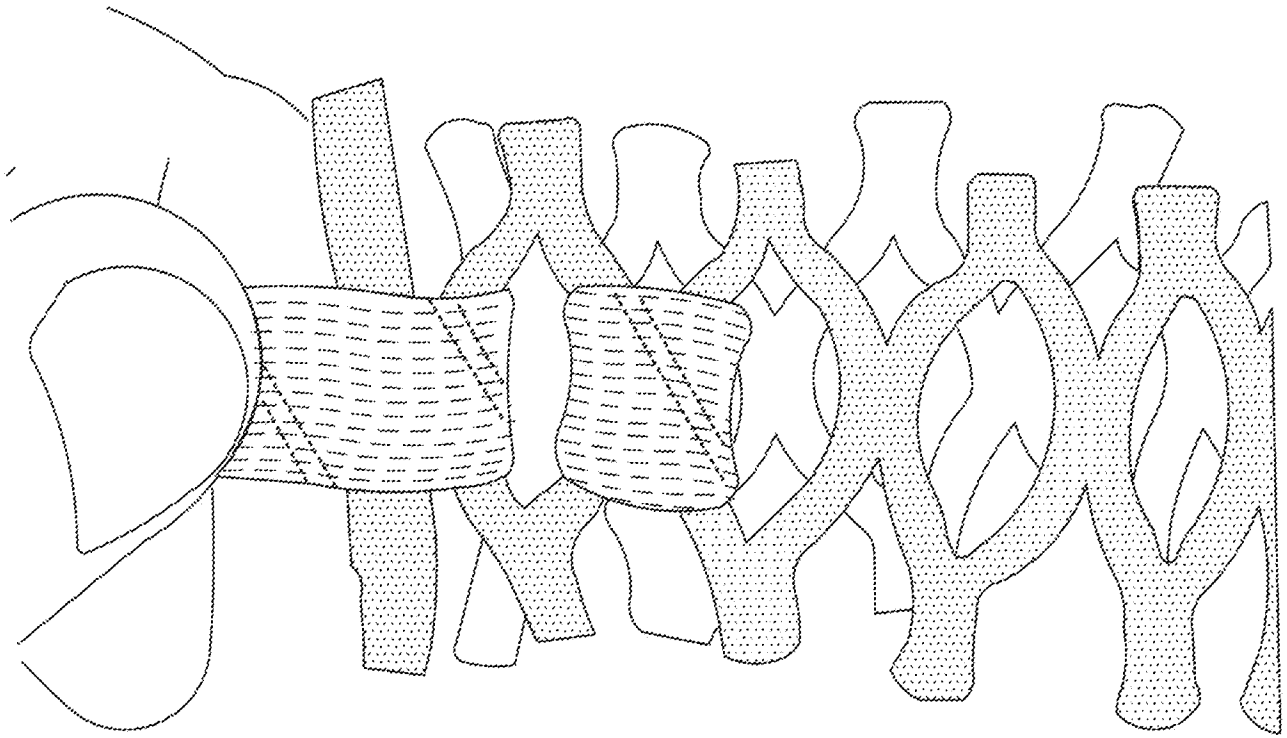
Figure 6:
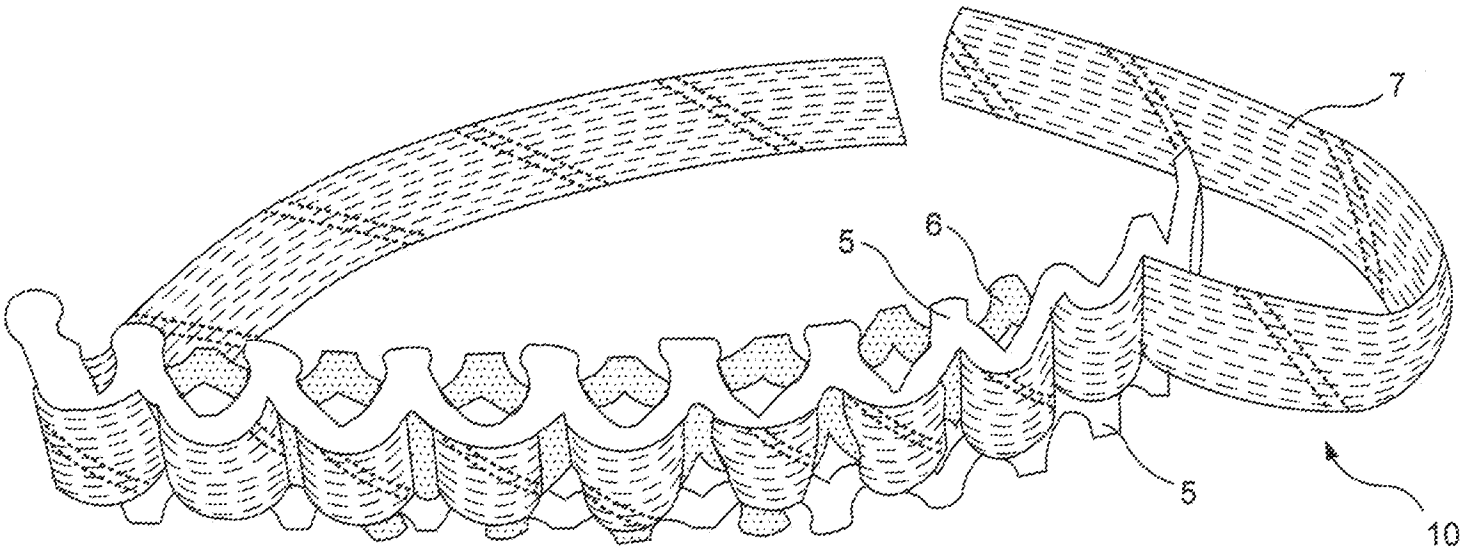
Figure 7:
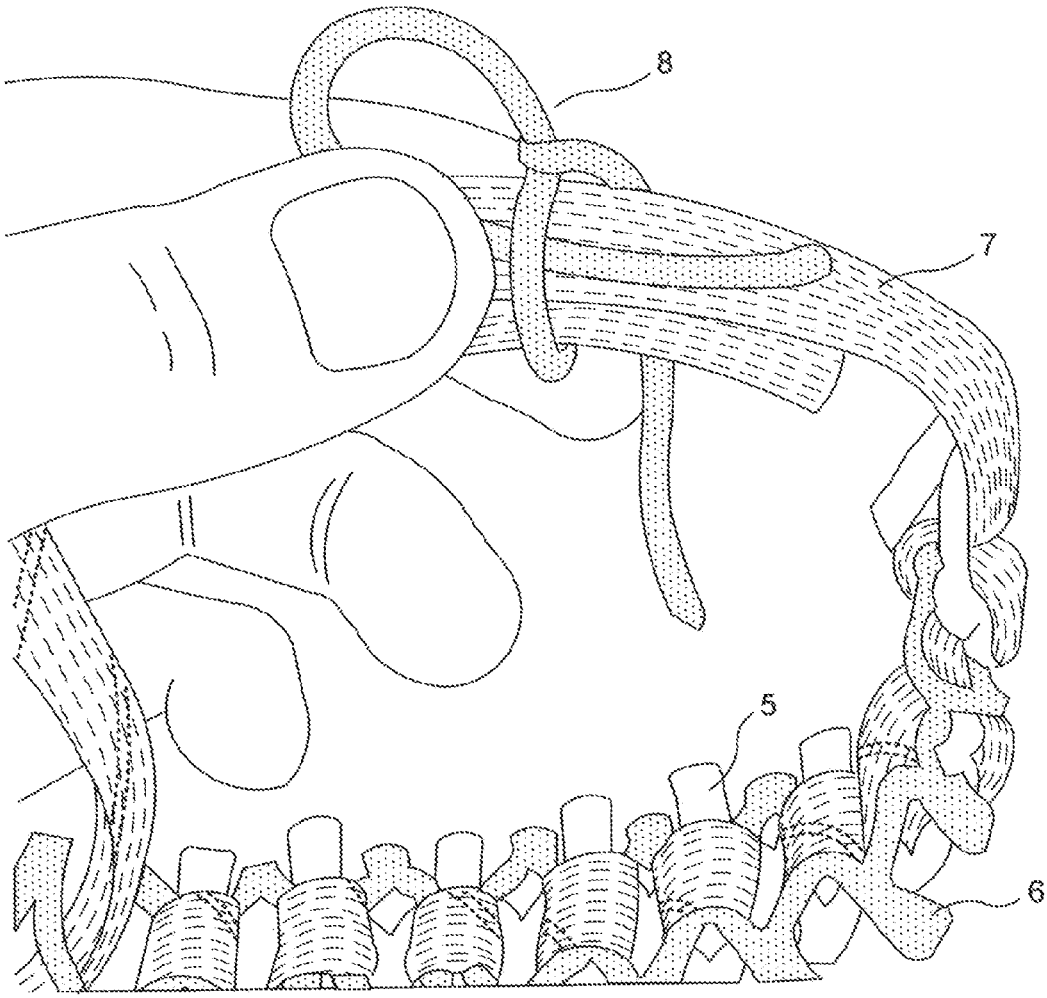
Figure 8:
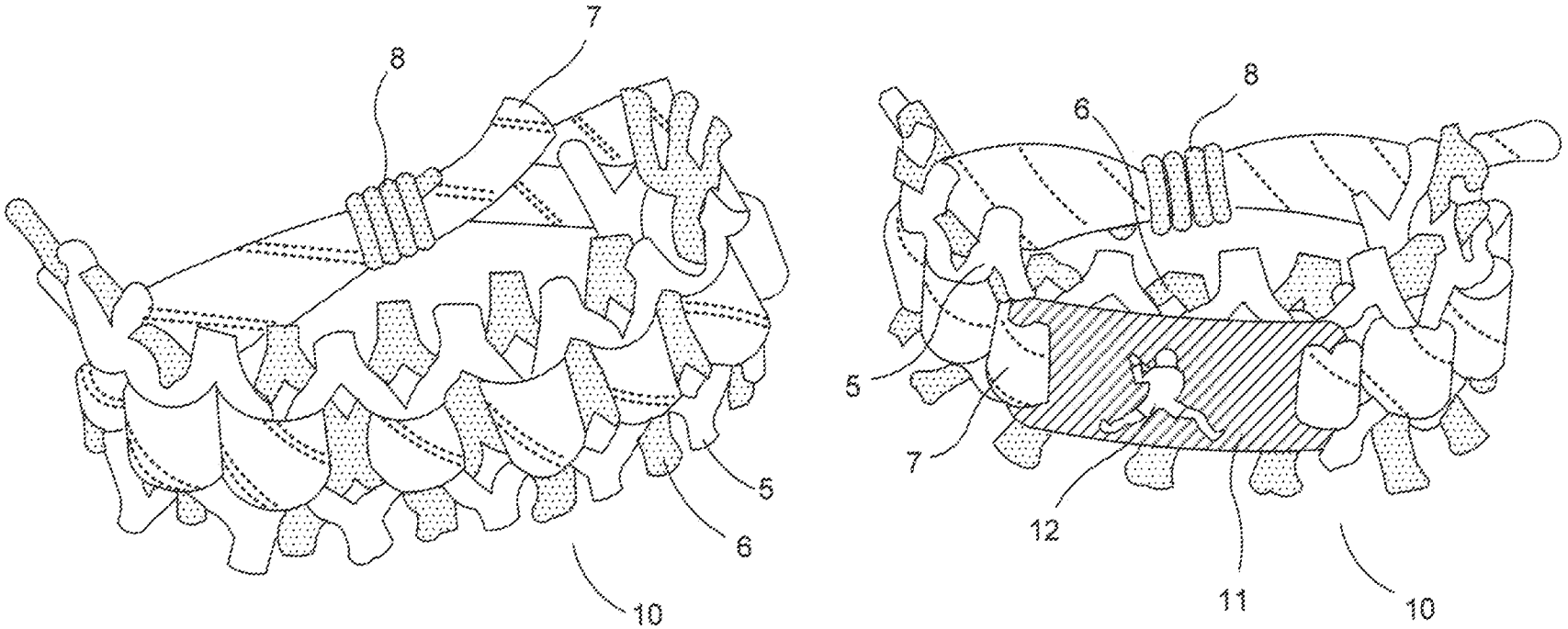
Figure 9:
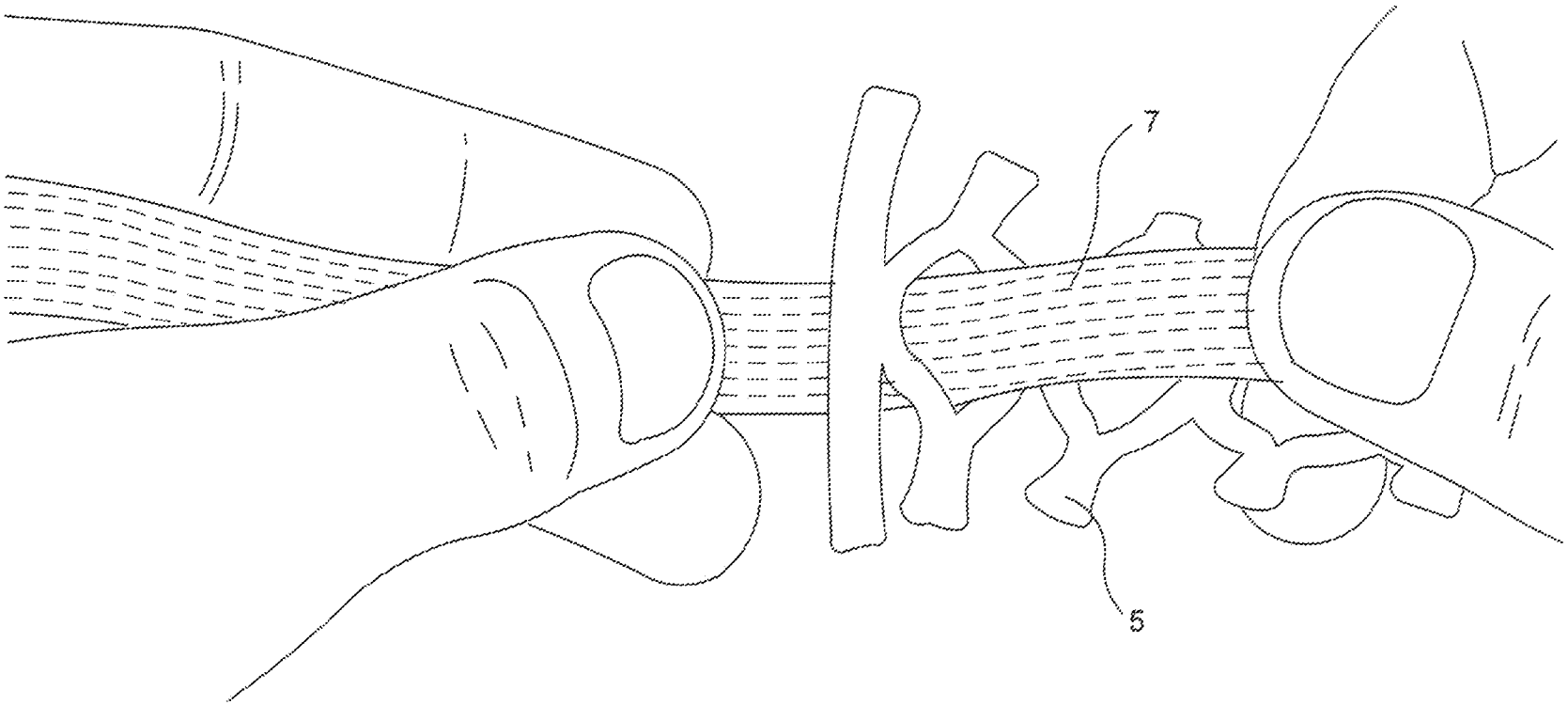
FIGS. 9-13 illustrate a second embodiment of the present disclosure in which an article is formed from just one colored netting materials where a shooting string is woven through the opening of the one netting material and the ends of the shooting string are pulled together and tied to adjustably fit the wearer and illustrating the steps thereof.
Figure 10:
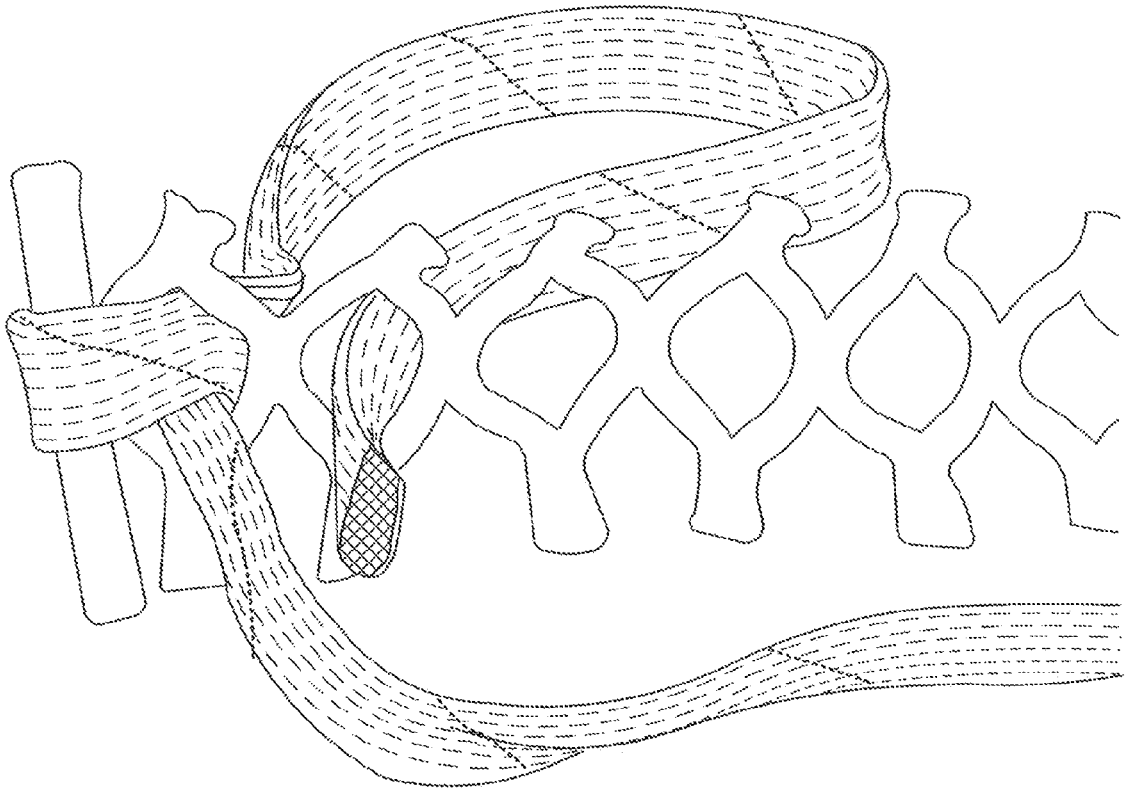
Figure 11:
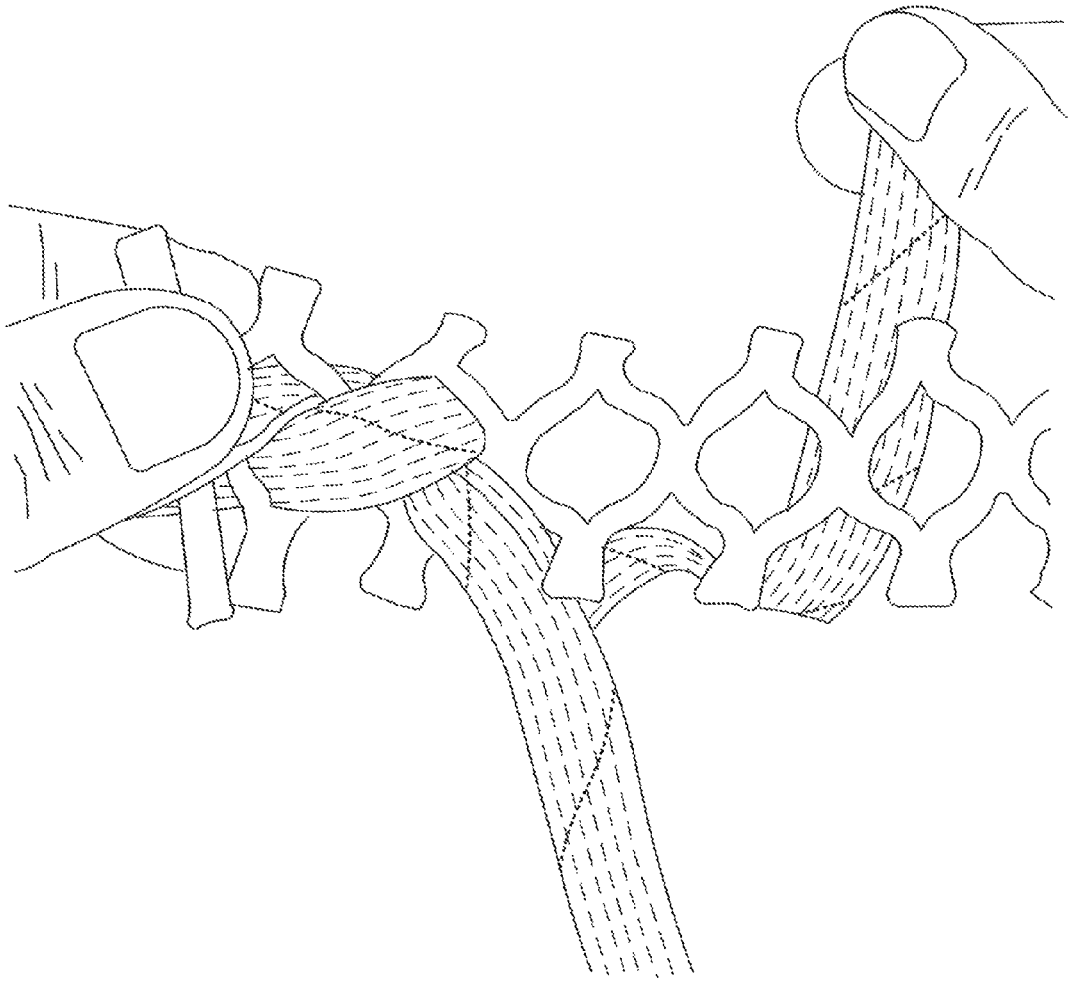
Figure 12:
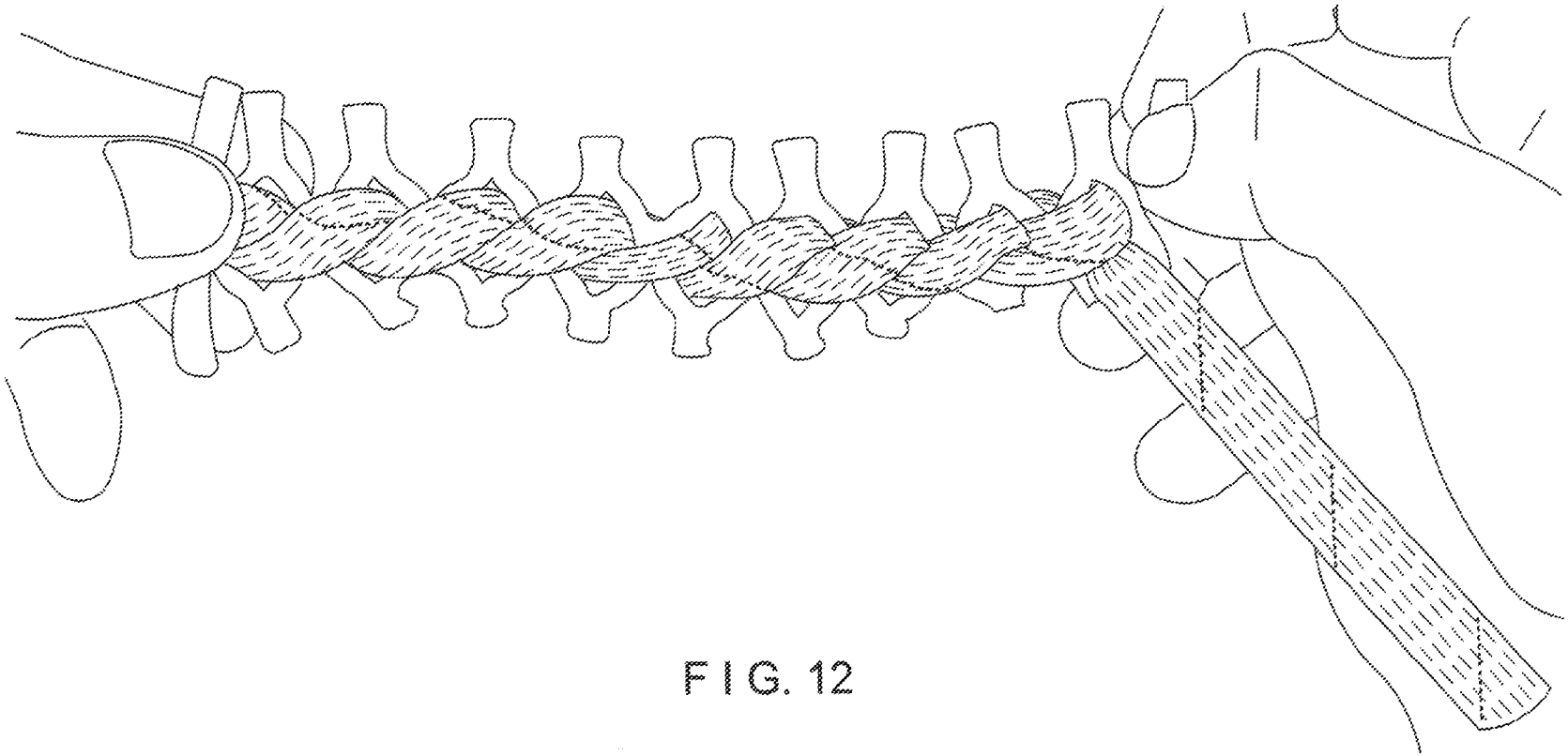
Figure 13:
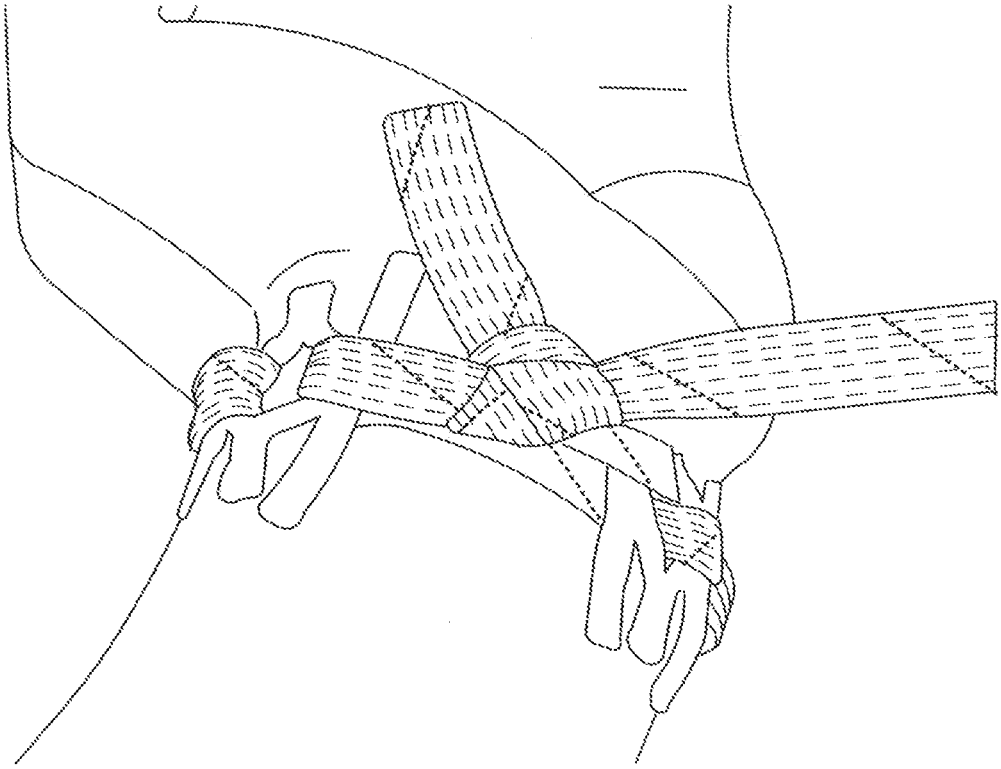

The article according to the first embodiment of the present disclosure can be made as follows:

Two separate and preferably differently colored from one another mesh netting Lacrosse material are selected as shown in FIG. 1. Each mesh netting is stretched longitudinally and horizontally to its desired width and length. Each of the two mesh pieces 5, 6 is cut to designated areas to form the diamond shaped pattern shown in FIG. 1. The edges of each mesh netting can be singed to prevent any possible fraying of the edges using any known means such as a cigarette lighter. If any browning occurs due to the singeing the browned portion can be trimmed away to reduce discoloration on the mesh netting. The two mesh nettings 5, 6 thus formed are placed in position so that one netting is on top of the other but off centered from one another so that the openings of the two mesh nettings appear in staggered arrangement from each other as shown in FIG. 1. A shooting string 7 used in Lacrosse is selected of preferably 30 inches in length and of any desired color (FIG. 2). The shooting string is interwoven through the mesh openings of the overlapping mesh nettings to secure them to each other as it forms the article as follows. Measuring approximately 8 inches on the shooting string and mark it and then take the end of the shooting string and push it through the first bottom opening from the underneath (the mesh netting behind the other mesh netting) and when it comes through have it go through to the left side of the top mesh nettings as shown in FIG. 7. Next pull the shooting string all the way to the 8 inch mark (FIG. 3) furthest from the 8 inch mark. Next take the longer end of the shooting string and pull it through the first top netting 5 (the mesh netting 5 on top of the underneath mesh netting 6) while making certain that the shooting string 7 reenters the opening of the bottom mesh netting 6 (FIG. 4). Next take the long end of the shooting string 7 and pull it through the second opening of the bottom mesh 6 netting and have it come through the first opening of the first top mesh netting 5 (see FIG. 5). Continue this weaving pattern as described above in the last two steps until the entire article 10 is woven (see FIG. 6). It is important that the shooting string is lying flat throughout the weaving pattern process to avoid any twisting in the shooting string. The shooting string is then measured at about preferably 4.5 inches on each side of the mesh netting edges and marked and trimmed on the marked spots. The edges are burned to reduce fraying. Knots are tied on each end of the shooting string (FIG. 7) with the added string material 8. The article 10 now looks as shown in FIG. 8 where it has been made as a bracelet. As shown in FIG. 8 a plate 11 with a name, design or logo 12 on it is affixed by adhesive at preferable the center of the front surface of the article by adhesive means or by any other known method to promote and advertise a product or for any other purposes or to enhance the decorative appearance of the article 10 (FIG. 8) in the printed advertisement. It is understood that any article of jewelry or certain garments e.g. belt, headband can also be made in this way.

FIGS. 9-13 illustrate a second embodiment of the present disclosure in which an article 10 is formed from just one colored netting materials 5 where a shooting string 7 is woven through the opening of the one netting material 5 and the ends of the shooting string 8 are pulled together and tied to adjustably fit the wearer (FIGS. 10, 11, 12 and 13). The methodology is the same as for the first embodiment except only one mesh netting 5 and one shooting string 7 are used and the shooting string is interwoven through the openings of the one mesh netting 5 and the shooting string 7 ends are knotted together to adjustably fit the wearer as shown in FIGS. 9-13.

In addition, for use with the first and second embodiments, a plate with a name, design or logo 12 on it is affixed at preferably the center of the front surface a the article 10 by adhesive means or by any other known means to promote and advertise a product or for any other purposes or to enhance decorative appearance of the article 10 (see FIG. 8).

While presently preferred embodiments have been described for purposes of the disclosure, numerous changes in the arrangement of method steps and those skilled in the art can make apparatus parts. Such changes are encompassed within the spirit of the invention as defined by the appended claims.

What is claimed:

1. A sports memorabilia article formed of interwoven material, comprising:

Two separate mesh netting materials arranged with one permanently offset from another one to provide a permanent staggered appearance; said two mesh netting materials being made of Lacrosse netting material;

a shooting string wherein the shooting string is interwoven through mesh openings of each of the two nettings to form the article; and marked and knotted at portions near end pieces of the shooting string, said end pieces being tied around a wearer's body part to be worn by the wearer.

2. The article according to claim 1 wherein said two mesh nettings are of two different colors from each other to provide an alternate color effect of said article.

3. The article according to claim 1 wherein there is only one mesh netting.

4. The article according to claim 1 wherein the article formed is a bracelet.

5. The article according to claim 1 wherein the article is a necklace.

6. The article according to claim 1 wherein the article formed is a wristwatch band.

7. The article according to claim 1 wherein the article formed is a belt.

8. The article according to claim 1 wherein the article formed is a head band.

9. The article according to claim 1 wherein the article formed is an article of jewelry.

10. The article according to claim 1 wherein the article formed is a garment article.

11. The article according to claim 1 wherein al plate with a name, design, logo on it to promote and advertise a product or for any other purposes or to enhance decorative appearance of the article is affixed at preferably the center of the front surface of the article by adhesive means or by any other known means.

12. A method of forming a sports memorabilia article of interwoven material, the steps comprising:

Selecting and sizing at least two separate mesh netting materials of Lacrosse netting material from each other and arranging one permanently offset from another one to produce a permanent staggered appearance;

and the shooting string is interwoven through the mesh openings of each of the two nettings to form the article one mesh netting material of Lacrosse netting material;

Selecting and sizing a shooting string;

Interweaving said shooting string is interwoven through the openings of the mesh of each of the two nettings to form the article;

and marking and knotting at the marked portions near end pieces of the shooting material and tying the ends of the shooting string around a wearer's body part to be worn by the wearer.

13. The method according to claim 12 wherein said mesh nettings of said at least one mesh netting are singed before being placed atop one another at their edges and burnt sections are trimmed away.

14. The method according to claim 12 wherein there are two mesh netting materials of different colors from each other and they are placed on atop the other slightly off centered from each other to give a staggered appearance and the shooting string is interwoven through the mesh openings of each of the two nettings to form the article.

15. The article according to claim 1 wherein said two mesh nettings are of two different colors from each other to provide an alternate color effect of said article.

16. The method according to claim 12 further comprising the step of affixing a plate with a name, design, logo on it to promote and advertise a product or for any other purposes or to enhance decorative appearance of the article a front surface of the article by adhesive means or by any other known means.

17. The method according to claim 15 wherein said plate is affixed to the center of said front of said article.

18. The method according to claim 12 wherein said selected two mesh nettings are of two different colors from each other to provide an alternate color effect.

* * * * *